United States Patent [19]

Beduhn et al.

[11] 4,042,115

[45] Aug. 16, 1977

[54] ROTARY COUNTERWEIGHT CRANE WITH A REMOVAL TRACK SECTION

[75] Inventors: Daniel E. Beduhn; James G. Morrow, Sr.; David J. Pech, all of Manitowoc, Wis.

[73] Assignee: The Manitowoc Company, Inc., Manitowoc, Wis.

[21] Appl. No.: 709,451

[22] Filed: July 28, 1976

[51] Int. Cl.[2] ..... B66C 23/72

[52] U.S. Cl. ..... 212/48; 212/66; 212/28

[58] Field of Search ..... 212/28, 48–50, 212/66–70; 104/48–49

[56] References Cited

U.S. PATENT DOCUMENTS

| | | | |
|---|---|---|---|
| 3,485,383 | 12/1969 | Beduhn | 212/48 |
| 3,777,900 | 12/1973 | Brewer | 212/48 X |
| 3,955,684 | 5/1976 | Novotny | 212/48 |

*Primary Examiner*—Robert J. Spar
*Assistant Examiner*—R. B. Johnson
*Attorney, Agent, or Firm*—Leydig, Voit, Osann, Mayer & Holt, Ltd.

[57] ABSTRACT

A crane assembly which, in heavy lifting configuration, has a platform with boom carrier and counterweight support rotatably mounted on a ring with the mounting including a king pin removably secured to the ring. For portability, the king pin and sections of the ring are removed and a transporter run within the ring and beneath the platform. The platform will easily accept a variety of hoisting machinery. Not only are the boom, mast and ring suitable for other crane configurations, but also the counterweight support and boom carrier are standard subcombinations held rigid with the platform through links defining triangular frames.

10 Claims, 6 Drawing Figures

10
11
12
13
14
15
16
17
18
19
21
22
23
25
26
27
31
32
33
34
35
36
40
41
45
51
52
55
56

ROTARY COUNTERWEIGHT CRANE WITH A REMOVAL TRACK SECTION

The present invention relates generally to high capacity lift cranes and more particularly concerns an assembly of crane components for lifting and transporting heavy loads.

Modern lift crane design is faced with a number of conflicting requirements. In the first place, high capacities are demanded, involving combinations of booms hundreds of feet long and loads ranging up to 1200 tons. Such high capacities are best handled by fixed or semi-portable configurations like the large ring concept disclosed and claimed in U.S. Pat. No. 3,485,383, issued Dec. 23, 1969, and owned by applicants' assignee. Most crane users also demand some degree of portability, which becomes increasingly difficult as designs are scaled up to handle greater loads.

Finally, the question of economy is always present and with larger, inherently more expensive, devices, the tying up of apparatus in a configuration where that apparatus is not utilized becomes increasingly costly.

It is therefore the primary aim of the present invention to provide a crane assembly made up of crane components that can be readily manipulated to create a high capacity crane that is semi-portable.

Another object of the invention is to provide an assembly as referred to above whose individual components are themselves relatively inexpensive, and which does not, in an operating mode, immobilize and leave inactive large components or sub-assemblies.

A further object is to provide a crane assembly of the above character that is not only versatile in the senses already mentioned, but which has further versatility in the sense of having components compatible with other crane systems and of being well suited for easily mounting a variety of machinery or machinery combinations to satisfy desired applications.

Other objects and advantages of the invention will become apparent upon reading the following detailed description and upon reference to the drawings, in which.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Figure 1:
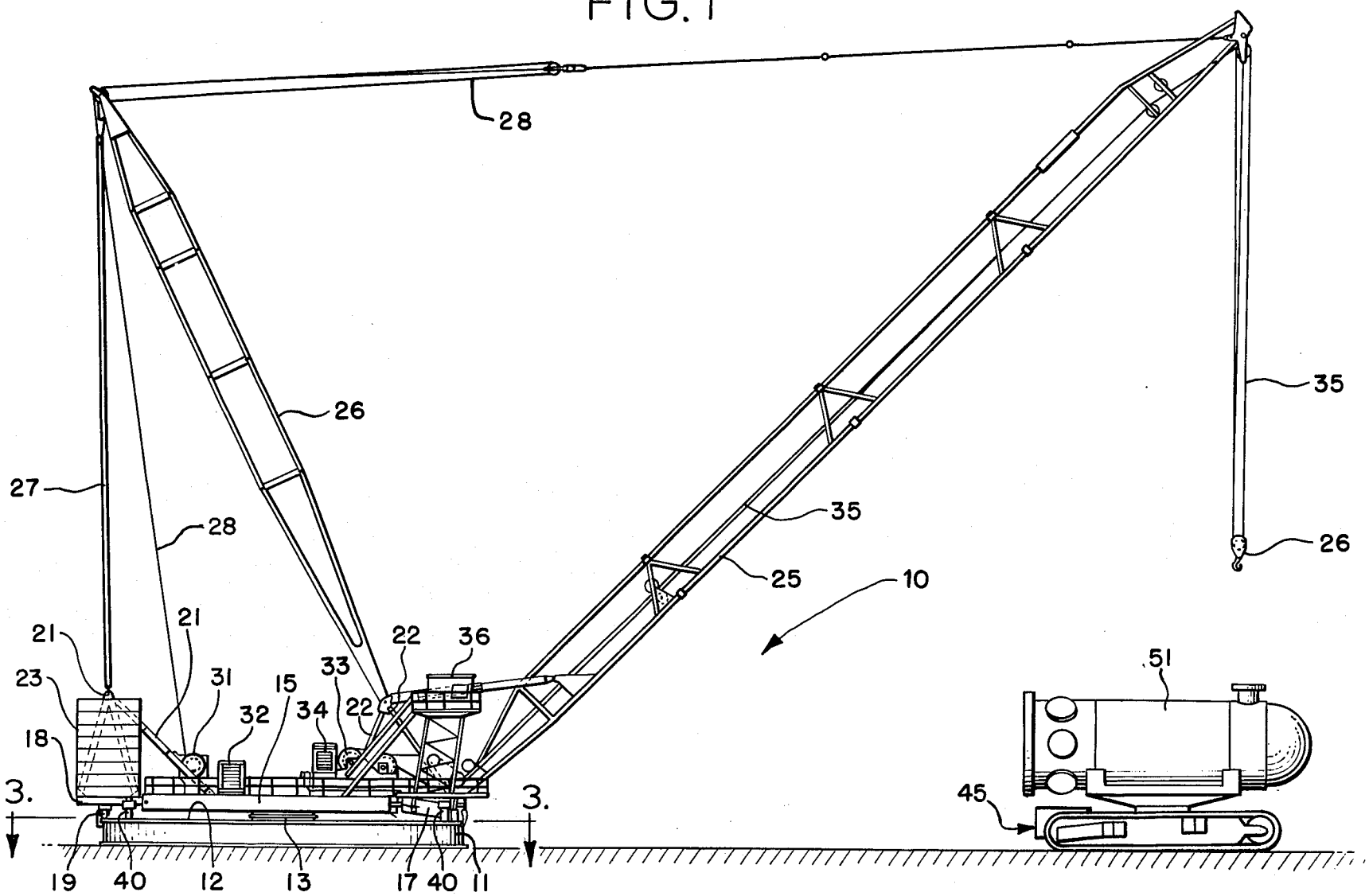
FIG. 1 is a side elevation of a crane assembly embodying the invention in a high capacity lifting configuration.
Figures 2, 5, 6:
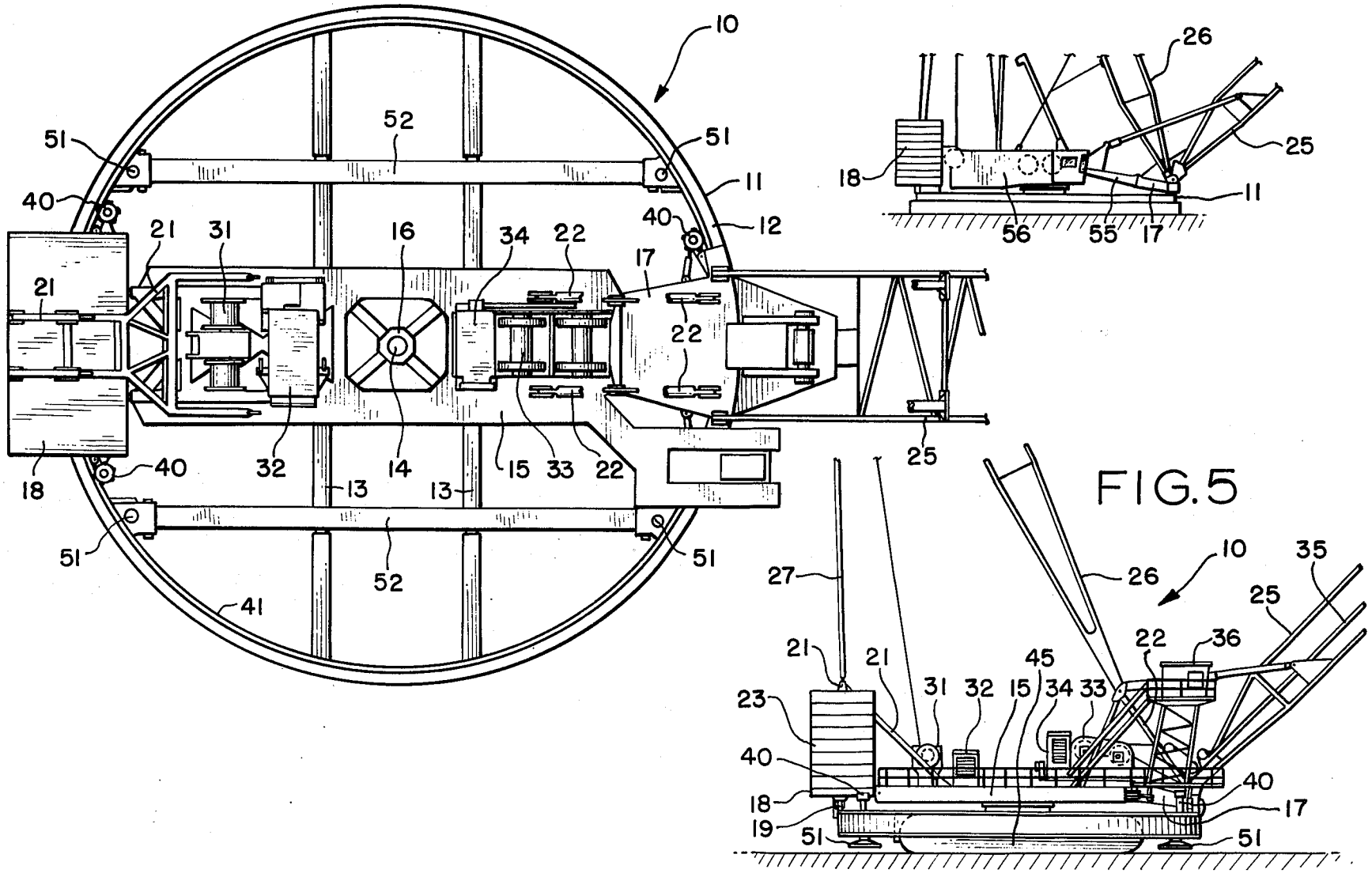
FIG. 2 is a plan, with some components sectioned, of the crane assembly shown in FIG. 1.
FIG. 5 is a fragmentary side elevation similar to FIG. 1 but showing the crane assembly in portable configuration.
FIG. 6 is a fragmentary elevation showing components of the FIG. 1 crane assembly utilized in an alternate crane system.

Turning first to FIGS. 1 and 2, there is shown a crane assembly 10 embodying the invention and including a ring 11 defining an annular track 12, structure 13 within the ring 11 supporting and including a central king pin 14, and an elongated platform 15 having a central sleeve 16 fitted for rotation on the king pin 14. It is one of the features of the invention that the platform 15 is simply that, a plain box-like weldment, having a boom carrier 17 pinned at one end in riding contact with the track 12 and a counterweight support 18 pinned at the other end also in riding contact with the track 12. The carrier 17 and the support 18 mount wheels 19 which ride on the track 12.

In carrying out the invention, first and second sets of links 21 and 22 define large triangular frames interconnecting the platform 15 and the respective carrer 17 and support 18 so as to hold these parts relatively rigid. Items of counterweight 23 are stacked on the support 18 so that the counterweight load, when the crane assembly is not operating, is transmitted directly to the track 12. A boom 25 with a load block 26 is pivoted on the carrier 17 just above the track 12 so that the fulcrum or tipping point for the load handling system is directly through the track.

As a feature of the invention, a mast 26, rigid links or pendants 27 and rigging 28 interconnect the counterweight support 18 and the boom 25 for positioning the boom through a vertical arc, with the mast 26 being secured to the platform at an upper portion of the second set of links 22 so that there is a substantially straight compression load line from the top of the mast 26 down to the boom pivot and fulcrum point, and with the links 22 defining an open, uncluttered region between the platform 15, the carrier 17 and the boom 25 for the passage and guidance of appropriate rigging. Since the platform 15 is simply a platform, a wide variety of power hoists can be readily mounted for power control of the boom 25 and its load block 26. In the illustrated embodiment, one hoist assembly 31 with its power plant 32 is mounted at the rear of the platform 15 for powering the boom hoist rigging 28, and a second hoist assembly 33 with its separate power plant 34 is mounted at the front of the platform 15 for powering the load block 26. The second hoist assembly 33 is fitted within and under the second set of links 22, and the open, uncluttered region allows appropriate fleating sheaves and other rigging controls to be easily mounted for controlling lines 35 interconnecting the hoist assembly 33 and the load block 26.

An elevated operator's house 36 is also mounted at one front side of the platform 15 and is provided with suitable controls for operating the various powered elements of the assembly. For rotating the platform 15 on the ring track 12, a plurality, four in the illustrated case, of swing assemblies 40 with power driven gears are mounted on the platform 15 and biased into engagement with a gear path 41 fixed on the ring 11. Swing drives of this kind are claimed and disclosed in greater detail in U.S. patent applications Ser. No. 522,787, filed Nov. 11, 1974, and Ser. No. 624,765, filed Oct. 22, 1975, both assigned to the assignee of the present case.

Figure 3:
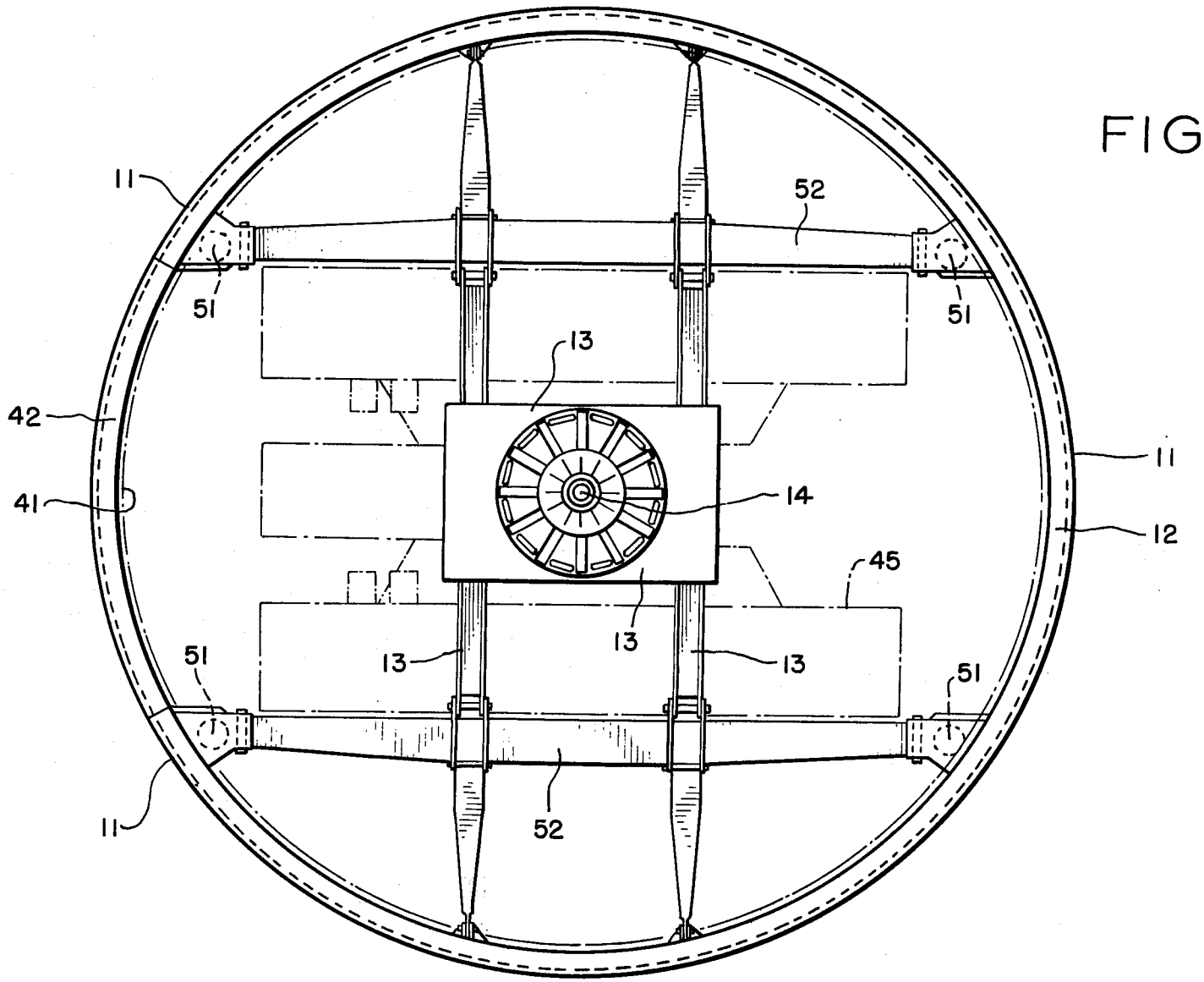
FIG. 3 is a section taken approximately along the line 3—3 in FIG. 1.
Figure 4:
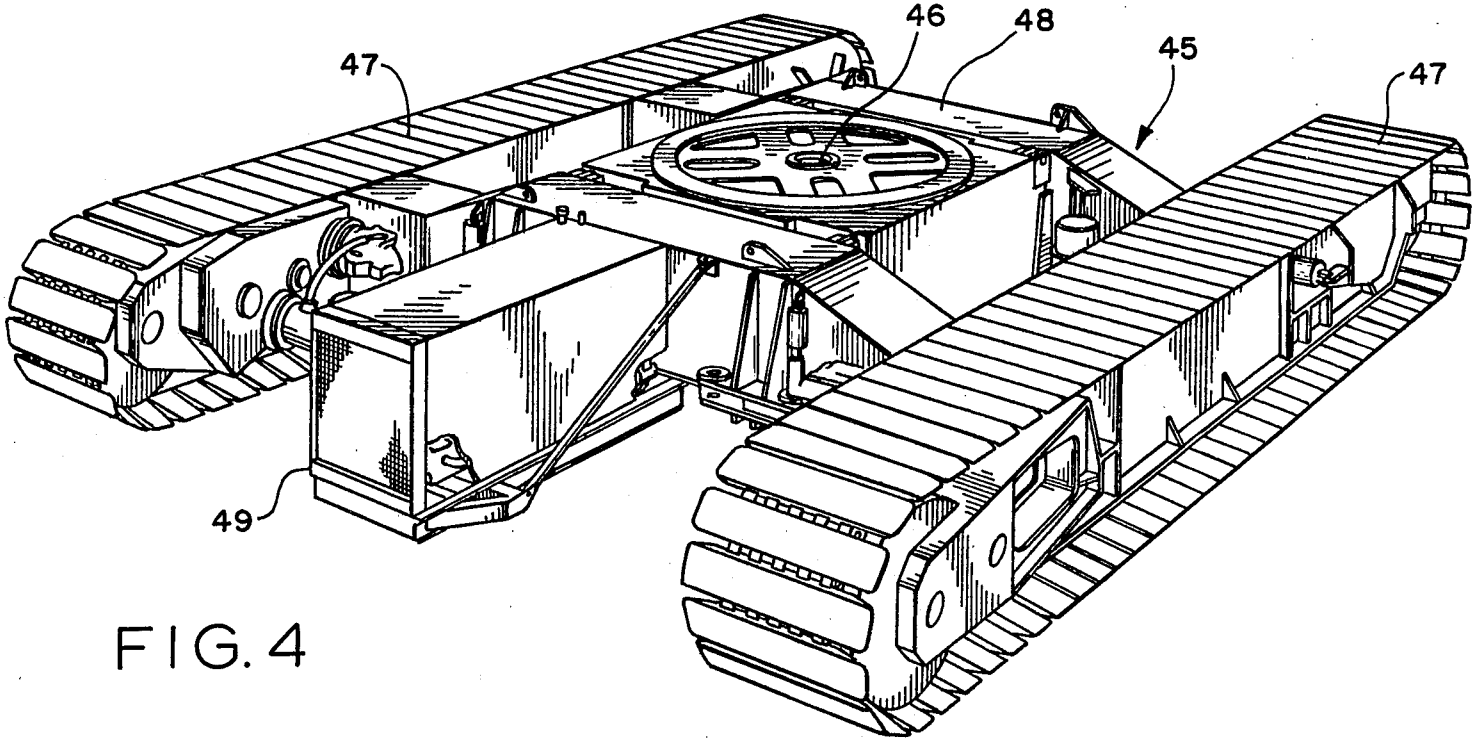
FIG. 4 is a perspective of a transporter constituting another element of the total crane assembly embodying the invention.

In accordance with the invention, the king pin support structure 13 is removable, as is a section 42 of the track ring 11 (see FIG. 3), so that a self-propelled transporter 45 having a king pin structure 46 can be run within the ring 11 and beneath the platform 15, and connected to the ring and platform to create a mobile assembly. Preferably the transporter 45 includes a pair of crawler tracks 47 mounted on a central frame 48 which also carries its own power plant 49. The transporter 45 is preferably similar to that claimed and disclosed in greater detail in U.S. patent applications Ser. No. 571,303, filed Apr. 24, 1975, and Ser. No. 685,689, filed May 12, 1976, both assigned to the assignee of the present invention. With the crane assembly 10 in its FIG. 1, lifting configuration, the transporter 45 is available for carrying heavy loads such as the illustrated vessel 51. The transporter 45 fits within the ring 11 between ring supporting beams 52 as shown in dashed lines in FIG. 3, and when the platform 15 and ring 11 are secured to the transporter, the assembly becomes mobile, as illustrated in FIG. 5, without further disassembly. To reverse the procedure when the crane assembly 10 has been walked to a new working position, the ring segment 42 is removed, the ring and platform detached from the transporter 45, and the transporter walked out to be replaced by the removable king pin assembly 13.

For facilitating the conversion from mobile configuration to a stationary lifting configuration, hydraulic jacks 51 are mounted on the ring 11 for selectively elevating the ring to permit ready disengagement of the platform 15 from the king pin structure on the transporter 45. Conversely, the jacks permit elevating the ring so that the transporter 45 can be readily positioned beneath the platform for engagement of the king pin 46 with the platform sleeve 16.

One of the features of the invention is the versatility inherent in having the assembly 10 made up of standard sub-assemblies. FIG. 6 shows the ring 11, boom carrier 17, boom 25, mast 26, and counterweight support 18 assembled together with a carrier extension 55 and a standard mobile crane 56 into the crane configuration claimed and disclosed in U.S. Pat. No. 3,485,383 referred to above. While the FIG. 6 assembly is an effective way of greatly increasing the capacity of the mobile crane 56, it can be readily understood that the basic crane 56 employed as a sub-assembly in the FIG. 6 arrangement is substantially more complex and expensive than the relatively simple platform 15 and its components, although the geometry being virtually identical, the FIG. 1 configuration gives virtually the same capacity as the FIG. 6 arrangement.

We claim as our invention:

1. A crane assembly comprising, in combination, a ring defining an annular track, removable structure mounted within said ring defining a central king pin, an elongated platform fitted for rotation on said king pin, said platform having a boom carrier at one end in riding contact with said track and a counterweight support at the other end also in riding contact with said track, a boom pivoted on said carrier above said track, means including a mast on said platform interconnecting said counterweight support and said boom for positioning said boom, a load block suspended on said boom, and means including powered hoists mounted on said platform for powered control of said boom and said load block, said ring having a removable section whereby said removable structure and said section can be removed from the assembly to permit a self-powered transporter having a king pin to be run within the ring and beneath the platform and be connected to the ring and platform to create a mobile assembly.

2. The combination of claim 1 including jacks on said ring for selectively elevating the ring to permit disengagement of said platform from said king pins.

3. The combination of claim 1 including a gear path fixed on said ring, and at least one power driven gear mounted on said platform and biased into engagement with said path for providing a swing drive for the assembly.

4. A crane assembly comprising, in combination, a self-powered transporter defining a central king pin, a ring releasably mounted on and surrounding said transporter with the ring defining an annular track, an elongated platform fitted for rotation on said king pin, said platform having a boom carrier at one end in riding contact with said track and a couterweight support at the other end also in riding contact with said track, a boom pivoted on said carrier above said track, means including a mast on said platform interconnecting said counterweight support and said boom for positioning said boom, a load block suspended on said boom, and means including powered hoists mounted on said platform for powered control of said boom and said load block, said ring having a removable section whereby said removable section can be removed and said ring released from said transporter so that the transporter can be run clear of the assembly and an alternate king pin for the platform secured within the ring to create a fixed location, high capacity crane.

5. The combination of claim 4 including jacks on said ring for selectively elevating the ring to permit disengagement of said platform from said king pins.

6. The combination of claim 4 including a gear path fixed on said ring, and at least one power driven gear mounted on said platform and biased into engagement with said path for providing a swing drive for the assembly.

7. The combination of claim 4 including a first set of links defining a triangular frame interconnecting said counterweight support and said platform to make these parts relatively rigid, and a second set of links defining a triangular frame interconnecting said boom carrier and said platform to make these parts relatively rigid, said second set of links defining an open, uncluttered region between said platform and said carrier for passage and guidance of rigging.

8. The combination of claim 7 wherein said mast is secured at an upper portion of said second set of links.

9. The combination of claim 1 including a first set of links defining a triangular frame interconnecting said counterweight support and said platform to make these parts relatively rigid, and a second set of links defining a triangular frame interconnecting said boom carrier and said platform to make these parts relatively rigid, said second set of links defining an open, uncluttered region between said platform and said carrier for passage and guidance of rigging.

10. The combination of claim 9 wherein said mast is secured at an upper portion of said second set of links.

* * * * *